US009200387B2

(12) United States Patent
Schadler et al.

(10) Patent No.: US 9,200,387 B2
(45) Date of Patent: Dec. 1, 2015

(54) APPARATUS FOR THREAD SEPARATION

(71) Applicant: Staubli Sargans AG, Sargans (CH)

(72) Inventors: Heinz Schadler, Eschen (LI); Gregory Busch, Landquart (CH)

(73) Assignee: STAUBLI SARGANS AG, Sargans (CH)

( * ) Notice: Subject to any disclaimer, the term of this patent is extended or adjusted under 35 U.S.C. 154(b) by 0 days.

(21) Appl. No.: 14/563,061

(22) Filed: Dec. 8, 2014

(65) Prior Publication Data

US 2015/0159306 A1 Jun. 11, 2015

(30) Foreign Application Priority Data

Dec. 9, 2013 (EP) ..... 13405136

(51) Int. Cl.

*D03J 1/14* (2006.01)
*B65H 69/04* (2006.01)
*D03J 1/18* (2006.01)

(52) U.S. Cl.

CPC . *D03J 1/14* (2013.01); *B65H 69/04* (2013.01); *D03J 1/18* (2013.01)

(58) Field of Classification Search

CPC ..... D03J 1/14; D03J 1/13; D03J 1/18; B65H 69/04; B65H 57/10; B65H 57/04; B65H 75/265; B65H 51/02; B65H 51/04; B65H 51/06

USPC ..... 28/198, 199, 202, 203.1, 204, 206, 211, 28/212, 172.2, 230; 242/172, 364.9, 472, 242/475.1, 602.1, 615.2

See application file for complete search history.

(56) References Cited

U.S. PATENT DOCUMENTS 1,339,313 A * 5/1920 Bearden ..... D03J 1/14 28/205
1,364,091 A 1/1921 Field
1,690,157 A * 11/1928 Becker ..... D03J 1/16 28/202
1,798,363 A * 3/1931 Bischof ..... D03J 1/14 28/198
2,149,536 A * 3/1939 Moncrieff ..... D06B 3/04 28/182
2,221,999 A * 11/1940 Kahlisch ..... B65H 54/14 242/479.6
2,564,330 A 8/1951 Fleischer
2,690,313 A * 9/1954 Mcdermott ..... B65H 57/16 242/157 R (Continued)

FOREIGN PATENT DOCUMENTS

EP 1 748 096 B1 1/2007
EP 1 870 501 A1 12/2007

(Continued)

OTHER PUBLICATIONS

European Search Report for 13405136.6 dated Feb. 17, 2014.

*Primary Examiner* — Amy Vanatta

(74) *Attorney, Agent, or Firm* — Pearne & Gordon LLP

(57) ABSTRACT

The present invention relates to a thread separating apparatus (11) for separating a thread (15) from a thread layer (13) comprising a first spindle (17) which is rotatable about an axis of rotation (18), in the circumference whereof a first helical guide track (27) is provided. The first spindle (17) during rotation is suitable for transporting a plurality of threads in the first helical guide track (27) along the first spindle (17). Located upstream of the first spindle (17) is a deflecting part (25) which provides for a deflection of the threads (15) from the first plane (16) into a second plane (35). At the rear end (33) of the first spindle (17), a first release edge (31) is provided for the release of the threads (15) from the second plane (35) into a third plane (39).

17 Claims, 7 Drawing Sheets

(56) References Cited

U.S. PATENT DOCUMENTS

| | | | | | |
|---|---|---|---|---|---|
| 2,696,654 | A | | 12/1954 | Townsend | |
| 2,755,036 | A | * | 7/1956 | Terho | B65H 75/18 242/390.3 |
| 3,197,838 | A | * | 8/1965 | Fauring | D02H 13/16 28/202 |
| 4,545,099 | A | * | 10/1985 | Tovenrath | D03J 1/14 28/202 |
| 2005/0173587 | A1 | * | 8/2005 | Raz | B65H 75/265 242/602.1 |
| 2010/0031484 | A1 | * | 2/2010 | Metzler | D03J 1/14 28/172.1 |

FOREIGN PATENT DOCUMENTS

| | | |
|---|---|---|
| GB | 687 132 | 2/1953 |
| GB | 2 117 419 A | 10/1983 |

* cited by examiner

APPARATUS FOR THREAD SEPARATION

The invention relates to an apparatus for separating a thread from a thread layer according to the preamble of claim 1.

PRIOR ART

U.S. Pat. No. 2,696,654 discloses a drawing-in machine in which the threads of a yarn sheet are grasped one after the other by means of a reciprocating needle and drawn through a conventional automatic weaving machine. In such a machine the threads of the yarn sheet are transported by means of a spindle having a helical groove in the circumference for the subsequent connection to the needle. By turning the spindle, the threads enter into the helical groove. In order that the spindle only takes up a single thread at one time, a separate warp thread capturing element is provided, which cooperates with the end of the lengthened section of the groove wall in order to define an inlet into the groove which is defined in width. The warp thread capturing element is movable relative to the lengthened section of the groove wall in order to adapt the width of the inlet to the thickness of the warp thread. The warp thread capturing element is the first element of the spindle which comes into contact with the yarn sheet during a rotation of the spindle. It has a pointed end which can dip between the two terminal threads so that in each case only a single thread is grasped. By twisting the warp thread capturing element relative to the spindle, the width of the inlet can be adapted to the thread diameter. It should be noted that in the apparatus of U.S. Pat. No. 2,696,654 the separation of the threads of the yarn sheet is accomplished by the warp thread capturing element before entry into the groove of the spindle.

OBJECT OF THE INVENTION

It is therefore the object of the invention to provide a thread separating apparatus which can reliably and reproducibly separate terminal threads of a tensioned thread layer so that these are available for further operations such as, for example the linking to another thread. It is a further object of the invention to propose a separating apparatus which is reconcilable with different thread thicknesses, i.e. can separate threads of various thickness without mechanical structural elements of the thread separating apparatus needing to be changed or adjusted. It is a further object to propose a thread separating apparatus which has a simple and compact design.

DESCRIPTION OF THE INVENTION

The present invention relates to thread separating apparatus for separating a thread from a thread layer defining a first plane and comprising a plurality of tensioned threads disposed adjacent to one another and substantially parallel to one another. Within the framework of the present invention it is assumed by definition that the threads of the thread layer extend in the Y-direction. The thread separating apparatus has a first spindle which is rotatable about an axis of rotation, in the circumference whereof a first helical guide track is provided. The spindle during rotation is suitable for transporting a plurality of threads in the helical track in an axial (X direction) direction of transport along the first spindle. The spindle is rotationally driven by means of a first drive which is in communication with the spindle.

According to the invention, a deflecting part is provided for a deflection of the threads received in the first guide track from the first plane into a second plane, and a first release edge is provided for the release of the threads from the first guide track into a third plane. The first release edge is in this case provided on the first spindle and is located at that point where the first helical guide track ends.

This embodiment has the advantage that a single geometry of the spindle—unlike the initially mentioned U.S. Pat. No. 2,696,654—can be used for thread separation for almost all types of thread having different properties. A thread separation can accordingly be achieved by building up a thread tension in the Z direction (perpendicular to the thread layer) so that a separation of the threads can take place at the release edge.

Within the framework of the present invention, a thread is deflected when the thread is removed from its rectilinear configuration in the thread layer.

Within the framework of the present invention, "helical" should also be understood as "spiral" if the spindle in the region of the guide track is not cylindrical but conical.

Preferably the first release edge is realized by a diameter reduction of the first spindle which release edge is formed in the base of the first helical guide track. That is, the guide track leads towards the steeply descending release edge at which the separation takes place. A spindle configured according to the invention can be produced at low cost.

Advantageously the deflecting part has a surface which is inclined with respect to the first plane of the thread layer. As a result of the inclined surface, a deflection of one or more threads from the plane of the thread layer can be brought about during operation of the thread separating apparatus. In this case, the threads are already pulled apart from one another during the deflection perpendicular to the first thread layer.

In principle, both the deflecting part and the spindle can be separate components. Then the first spindle can be twisted relative to the deflecting part and be displaceable together with the deflecting part in the axial direction.

Advantageously the deflecting part is configured as a cone, conus, truncated cone having a straight or curved deflecting surface which can effect a deflection of the outer threads of the thread layer. The deflecting part has a smooth (grooveless) surface. It is important for a good functioning that the frictional force between threads and deflecting surface is as small as possible.

Preferably the deflecting part is part of the first spindle and has an ogival surface. In this case, the first spindle can have the shape of a convex surface inclined with respect to the axis of rotation of the first spindle with a progressive change in diameter such as a circular cylinder, a cone or a truncated cone.

According to a particularly preferred embodiment a plurality of helical guide tracks are formed in the circumference of the first spindle whereby a multistart thread is formed.

Each guide track has a separate thread inlet. Accordingly each guide track has its own first release edge. In this embodiment threads can therefore enter into one of the guide tracks at various rotational positions of the first spindle. As a result a larger number of threads can be received in the guide tracks of the first spindle during a rotation of the first spindle. The performance of the thread separating apparatus can thus be improved.

According to an advantageous embodiment a transport apparatus is provided on the release edge for transporting away the threads released by the first spindle, e.g. at a measurement position. The transport apparatus can be driven by a second drive. Through the provision of a transport apparatus, each separated thread can be removed from the region of the first release edge.

Advantageously the threads are transported at a first transport speed in the first guide track and at a second transport speed on the transport apparatus. In this case the second transport speed is greater than the first transport speed. The thread separation can be significantly intensified by the transport apparatus operated at higher speed.

Advantageously the first spindle is driven by a first drive and the transport apparatus is driven by a second drive. However, it is feasible to have only one drive and corresponding transmission for operation of the first spindle and the transport apparatus at different speeds.

Expediently the transport apparatus is formed by a second rotatable spindle hereinafter called "transport spindle". In the circumference of the second spindle, a second helical guide track, e.g. a screw thread, is provided. The guide track of the second spindle serves to receive and further transport a thread released from the first spindle. First spindle and second spindle are preferably disposed coaxially with respect to one another.

Advantageously the diameter of the second spindle is smaller than the diameter of the first spindle. Preferably the diameter of the second spindle is 0.3 to 0.8 times the diameter of the first spindle (measured perpendicular to the axis of rotation on the first release edge).

Advantageously the second spindle has a second release edge adjoining the second helical guide track for the release of the threads from the second guide track into a fourth plane. In this case, the thread capturing point in the fourth plane can serve as a measurement position in order to check a separated thread with regard to parameters of interest such as achieving the separation, colour, thickness etc.

The first and second helical guide tracks can be configured as grooves and/or as elevated screw thread. Both embodiments form a threaded notch and are inexpensive to achieve.

In principle it is feasible that a third rotatable spindle is provided after the second spindle in order to achieve the separation of the threads of one thread layer with very high reliability.

The second spindle can be ogival, frustoconical or conical in longitudinal section. With such a shape the second spindle produces a higher thread tension in the Z direction than with a cylindrical shape. As a result, a hook has more free space in the Z direction in order to grasp the separated thread released from the second spindle and remove it from the test position.

Advantageously the thread separating apparatus has a feed drive for displacing the first spindle with respect to the thread layer substantially parallel to the first plane of the thread layer.

Advantageously a control device for controlling the feed drive and a thread testing apparatus which is in communication with the control device are provided. The rotational speed of the spindles can be individually adjusted with the aid of the control. The thread testing apparatus is suitable for monitoring a thread released by the first spindle. In one variant the thread testing apparatus (camera) is suitable for monitoring the entire thread separation process whereby its monitoring field covers a thread from its position in the thread layer as far as its position in the fourth plane.

Advantageously about an axis of rotation of the first spindle a first angular section is defined as release rotation region and a second angular section is defined as dead rotation region. In this case the first spindle is rotationally driven more slowly in the release rotation region than in the dead rotation region. As a result of this operating mode a temporal optimization of the separation process can be achieved. Also the performance of the separation (with regard to the number of separated threads per minute) can be improved. In one variant a first angular section is defined as release rotation region and a second angular section is defined as dead rotation region for the second spindle having a second guide path, where the second spindle in the release rotation region is rotationally driven more slowly than in the dead rotation region of the second spindle.

The subject matter of the present invention is also a knotting machine comprising two thread separating apparatuses according to the invention.

A further subject matter of the present invention is a leasing machine comprising a thread separating apparatus according to the invention. The leasing machine makes a lease between all the threads of a thread layer separated with the thread separating apparatus.

Another subject matter of the present invention is a drawing-in machine with a thread separating apparatus according to the invention. The drawing-in machine draws a thread separated with the thread separating apparatus into a weaving harness, i.e. into a drop wire, into a heald and/or into a reed.

A further subject matter of the present invention is a method for separating a single thread from a thread layer defining a first plane and comprising a plurality of threads disposed adjacently and substantially parallel to one another, comprising the following process steps:

a) Deflecting a plurality of threads in a first direction from the first plane into a second plane which is substantially parallel and at a distance from the first plane,
b) Gripping one or more threads with the aid of a rotating spindle in the circumference whereof a helical guide track is formed,
c) Transporting the at least one thread along the rotating spindle to a release edge and
d) Allowing an individual thread to spring back into a third plane which is located parallel to and between the first and the second plane.

This method has the major advantage that it can be achieved with simple means and reliably and regularly enables the separation of one thread of a thread layer.

Advantageously the threads received in the helical guide track are deflected in a second direction which runs at an angle and preferably approximately perpendicularly to the first direction.

Advantageously a plurality of threads are transported during operation in the guide track and the separation of the threads is accomplished at the latest at the release edge of the spindle. This method is impressive due to its simplicity and reliability.

Advantageously a plurality of threads are separated per complete rotation of the first spindle, i.e. a plurality of threads can be received in one thread pitch which, for example, are released one after the other by rotation of the first spindle in the release rotation region.

According to a preferred variant of the method, the first spindle is intermittently rotated, i.e. it is alternately rotated through a few angular degrees and then stopped or accelerated. Alternatively the first spindle can be rotated more slowly in the release rotation region than in the dead rotation region so that the threads jump off successively in time.

The separated threads can be checked on the third plane or transported from the third plane further to a measurement position. Particularly preferably the separated thread is transported further from the third plane to a second release edge from where the thread is released onto a fourth plane. This variant has the advantage that the quality of the separation is improved.

Advantageously the threads are transported at a first axial transport speed to the first release edge of the first spindle and from there at a greater second axial transport speed to the second release edge. This has the advantage that threads released from the first release edge are transported away rapidly and the space becomes free for a following thread.

An exemplary embodiment of the invention is now described with reference to the drawings. In the figures:

FIG. 1 shows in section an exemplary embodiment of a thread separating apparatus according to the invention comprising a first spindle (hereinafter also designated as "grouping spindle"), which is preceded by a deflecting part, and a smaller-diameter second spindle located after the first spindle (hereinafter also designated as "transport spindle") as well as first and second drives for driving the two spindles individually and differently with respect to each other;

In the following description the entire arrangement comprising a thread separating apparatus according to the invention and a stenter frame is described relative to a coordinate system in which the threads tensioned in the stenter frame run in the Y direction. The thread separating apparatus and the stenter frame are moved relative to one another during operation in the X direction and thus define the transport direction. During the thread separation the threads are, for example, transported on the grouping spindle in the X direction from "in front", i.e. from a tip, further to the rear (in FIG. 2 from left to right).

Figure 1:
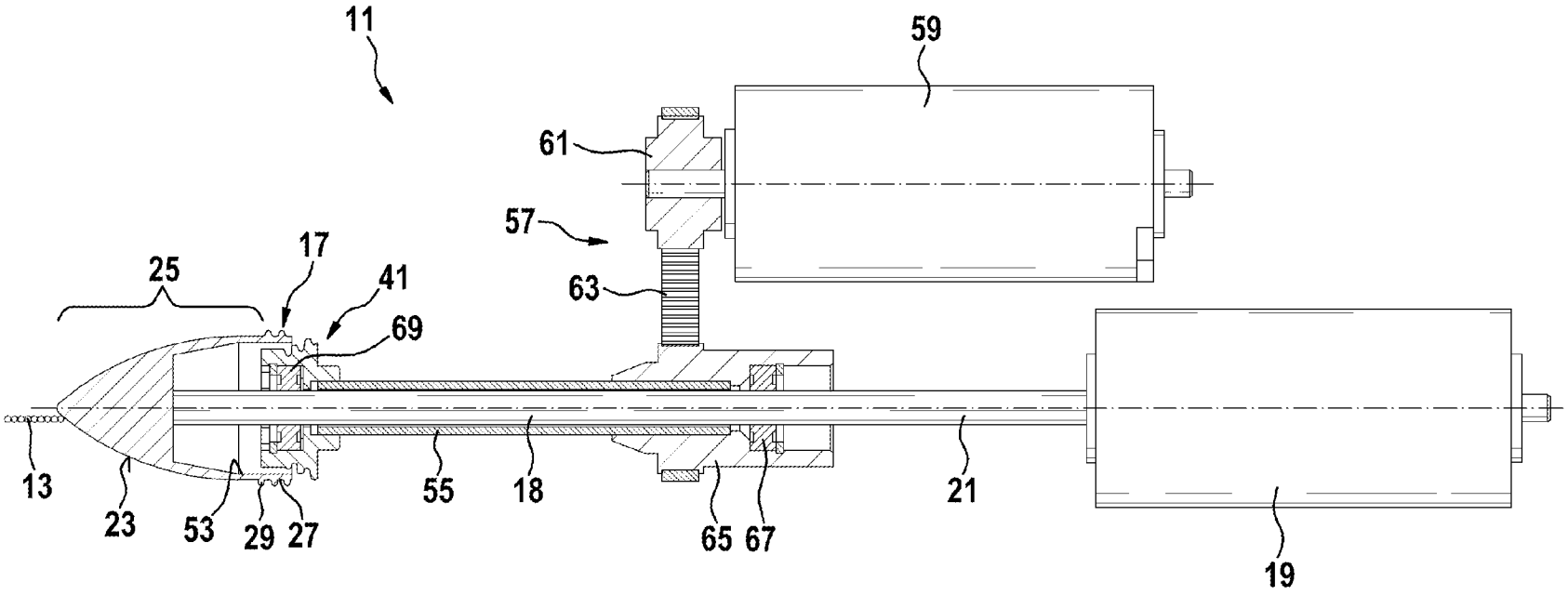
Figure 2:
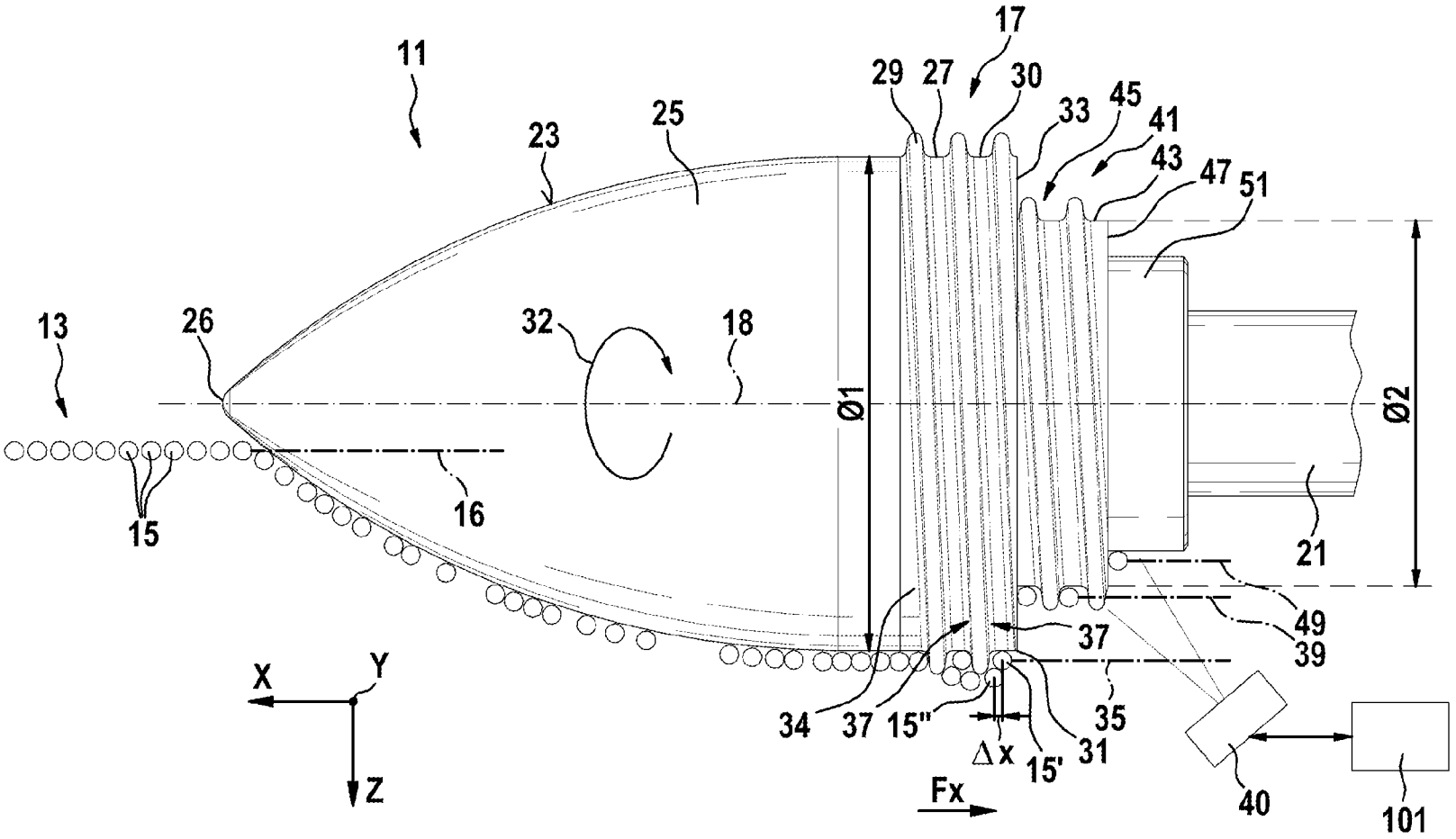
FIG. 2 shows the grouping spindle and the transport spindle from FIG. 1 during operation in a side view.
Figure 3:
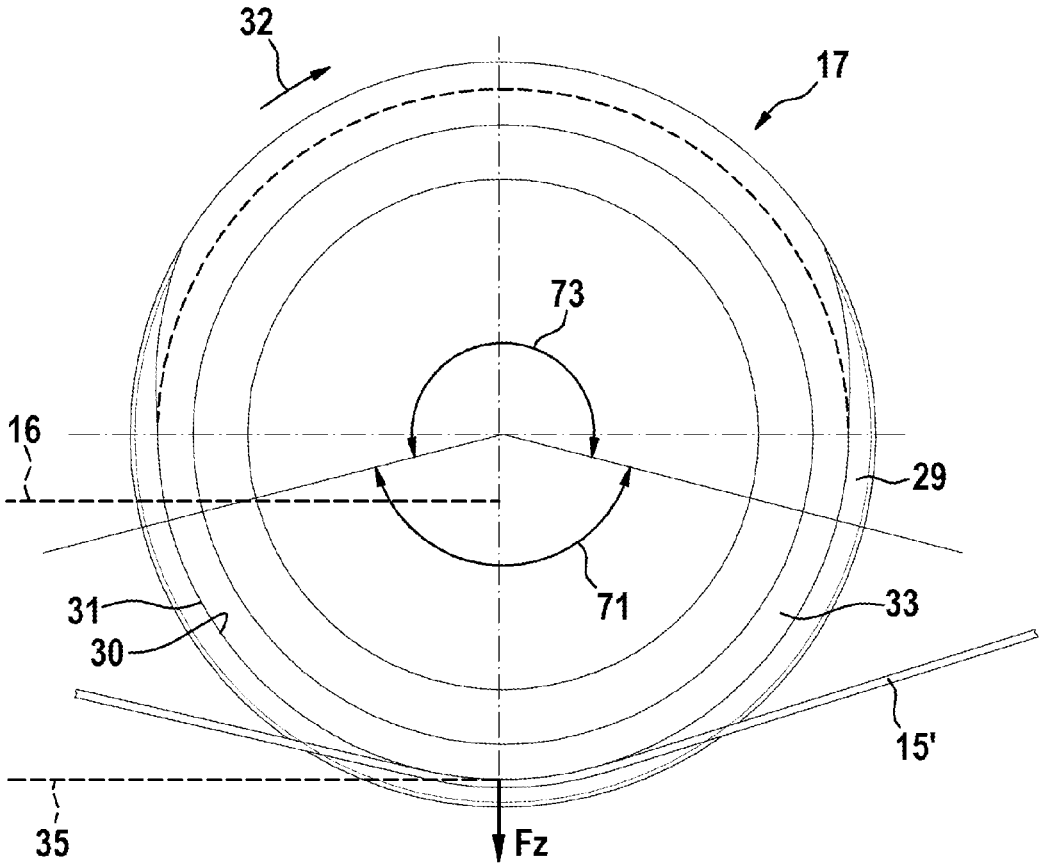
FIG. 3 shows a rear view of the grouping spindle from FIG. 1 and a thread deflected as far as into the second plane.

The thread separating apparatus shown in FIGS. 1 to 3 is used for separating an individual thread from a yarn sheet or thread layer 13. A thread layer 13 consists of a plurality of threads 15 disposed adjacent to one another and substantially parallel to one another. In the first plane 16 the threads 15 of the thread layer 13 are tensioned by clamping them at least at two points in a stenter frame and defining a first plane 16 between these two points. By definition the threads of the first thread layer are disposed adjacent to one another in the X direction.

The thread separating apparatus 11 comprises as an essential component a first spindle serving as thread separating unit which is subsequently designated as grouping spindle 17. The grouping spindle 17 is rotable about an axis of rotation 18 and configured to be driven by a motor 19. At the front end the grouping spindle 17 has a deflecting part 25 with an outer surface 23 having a substantially ogival cross-section. The deflecting part 25 therefore has a diameter which increases from front to back, from a tip 26 to the diameter Ø1. The deflecting part 25 provides for the deflection of the threads from the plane 16 of the thread layer 13 during operation of the apparatus 11, i.e. when it penetrates into the thread layer. An external helical guide track 27 in the form of a screw thread 29 having the axis of rotation 18 is provided adjoining the deflecting part 25. The guide track of the screw thread 29 is configured as a groove with a groove base 30 (cylindrical, diameter Ø1). A plurality of threads 15 of the thread layer can be located in guide track 27, i.e. the guide track 27 therefore does not effect a separation of the threads in each case but merely a grouping of the threads in a thread pitch between two adjacently located flanks 37 of the guide track 27. One group of threads can in this case comprise between 1 and 20 threads depending on the thickness of the track and thickness of the threads. The helical guide track 27 leads the grouped threads 15 as far as a release edge 31 where the separation of the threads 15 takes place at the latest as will be explained by means of the following brief functional description. The release edge 31 is a sharp edge of the first spindle 17 where the external diameter of the spindle 17 is severely reduced and at which the guide track 27 ends. Specifically the release edge 31 is disposed on the groove base 30 of the first helical guide track 27 and at the rear end 33 of the first spindle 17 perpendicular to the axis of rotation 18.

To separate the threads of the thread layer 13, the grouping spindle 17 is preferably moved approximately perpendicular to the running direction (Y direction) of the threads 15 parallel to the first plane 16, i.e. in the X direction, into the thread layer 13. In the view according to FIG. 2, the grouping spindle 17 is turned clockwise (arrow 32) about the axis of rotation 18 and at the same time moved in the X direction into the tensioned thread layer 13 in such a manner that the threads 15 are moved out from the plane 16 of the thread layer 13 in the Z direction (perpendicular to the first plane 16 of the thread layer 13 and to the axis of rotation 18). In so doing each thread 15 naturally still remains clamped in the stenter frame at the two points. Only the outermost thread sheet of the thread layer slides in the deflecting part 25 towards the rear as far as the surface having the diameter Ø1. As a result of the deflection of the threads, their thread tension increases in the Z direction. At the same time the threads are partially splayed because the curvature of the surface 23 describes a longer path than a straight line lying in the plane 16 of the thread layer 13. As soon as one or more threads reach the inlet 34 of the guide track 27, these are gripped by the rotation of the grouping spindle 17 in the guide track 27 and move in the guide track 27 along the first spindle 17 onto the release edge 31. In so doing the thread tension is increased further because the thread or threads are now also deflected in the X direction (i.e. towards the rear). Consequently a tension acting in the Z and in the X direction is built up as a result of the deflection in the deflected threads. Having arrived at the release edge 31 the threads are deflected and tensioned relative to their original configuration in the thread layer 13 in the Z direction and in the X direction. In this position the threads 15 in contact with the first spindle 17 define a second plane 35 running substantially parallel to the first plane 16 and up to which the threads 15 are deflected in the Z direction. As a result of the increased thread tension and the deflection in the X direction, the threads press against the flank 37 facing away from the spindle tip 26 (in FIG. 2 the flank oriented towards the rear (right)) of the screw thread 29. A release of the rear thread received in the guide track 27 in the direction of the axis of rotation 18 (Z direction) then takes place to a third plane 39 as soon as this crosses the release edge 31. If for example two threads 15' and 15" are located in the same thread pitch of the guide track 27 (FIG. 2), as a result of the elastic restoring forces acting in the X and Z direction, a slight displacement of the threads nevertheless takes place in the x direction ($\Delta x$). This difference $\Delta x$ helps to make the threads 15' and 15" jump off from the grouping spindle 17 at different times and to achieve a reliable separation of the threads at the latest upon release from the release edge 31. For the separation of two threads received in the same thread pitch, a rotation of the grouping spindle 17 merely by a few angular degrees is usually sufficient. When the separated thread has arrived in the third plane 39, for example with the aid of a camera 40 or another sensor, it can be checked whether a single thread is actually present or not and whether the thread has the correct diameter and/or colour or not.

According to an advantageous further development of the invention, a second spindle which is designated as transport spindle 41 is partially disposed at the release edge 31 and behind the grouping spindle 17. The transport spindle 41 serves as a notched transport apparatus. The transport spindle 41 can receive and further transport a thread released from the grouping spindle 17. For this purpose the transport spindle 41 also has in the circumference an external helical guide track 43 in the form of a second screw thread 45. The second screw thread 45 also defines a groove with a groove base which corresponds to a diameter Ø2. The receiving position of the threads 15 on the transport spindle 41 defines a third plane 39 which is substantially parallel to the first plane 16 and at a distance from the first and second planes 16, 35 in the Z direction. From the first release edge 31 the threads fall into the guide track 43 at the height of the diameter Ø2, where a released thread 15 is in contact with the second spindle 41. With the rotation of the transport spindle 41 the thread is moved in the guide track 43 along the transport spindle 41 away from the grouping spindle 17 (towards the rear). The guide track 43 ends at a second release edge 47 from where a thread can jump back into a fourth plane 49. The fourth plane 49 is defined by a cylinder part 51 disposed or formed on the transport spindle 41 and on which a thread separated from the thread layer can rest. The second release edge 47 is a sharp edge of the transport spindle 41 where the outer diameter of the transport spindle 41 is severely reduced and at which the guide track 43 ends. The second release edge 47 is disposed specifically on the groove base of the second helical guide track 43 and at a shoulder of the transport spindle 41. The fourth plane 49 is located between the first plane 16 and the third plane 39 in the Z direction.

As can be seen from FIG. 1, the transport spindle 41 projects so far into a rear-side recess 53 of the grouping spindle 17 that an overlap is achieved between the rear end 33 of the first spindle 17 at the first release edge 31 and the guide track 43 of the transport spindle 41 in the X direction. A thread jumping back from the first release edge onto the transport spindle 41 thus comes directly into engagement with the second guide track 43.

The transport spindle 41 is driven by a hollow shaft 55 about the axis of rotation 18, the hollow shaft 55 being in communication with a motor 59 via a traction drive 57. The traction drive 57 comprises a motor-side drive roller 61, a drive belt 63 and a spindle-side drive roller 65 which is connected in a torque-resistant manner to the hollow shaft 55. In the hollow shaft the drive shaft 21 is mounted freely rotatably by means of bearing bushes 67, 69. The first spindle 17 and the second spindle 41 move together with respect to the thread layer 13 in the X direction. Through the provision of two different rotary drives the grouping spindle 17 and the transport spindle 41 can be driven differently from one another, in particular at different rotational speeds.

FIG. 3 shows the grouping spindle 17 from the back. Due to the screw thread 29 a release of a thread at the first release edge 31 is only possible in a release rotation region 71 determined by the rotational position of the grouping spindle 17 relative to the threads 15 received in the guide track 27. In a rotational position of the grouping spindle 17 in a dead rotation region 73 no thread release is possible since the thread or threads are still too far from the first release edge 31 and since, when viewed in the X direction, at least one flank 37 of the screw thread is located between the threads and the rear end of the first spindle 17. In one rotational position of the grouping spindle 17 in the release rotation region 71 there is no longer any flank between the threads grouped in the rear thread pitch of the guide path 27 and the first release edge in the X direction. The knowledge of the different rotation regions can be used to accordingly adapt the rotational speed and therefore the transport speeds of the threads on the first and second spindle in the X direction. FIG. 3 shows the spindle 17 in a rotational position in the release rotation region 71 opposite the threads.

Figure 4:
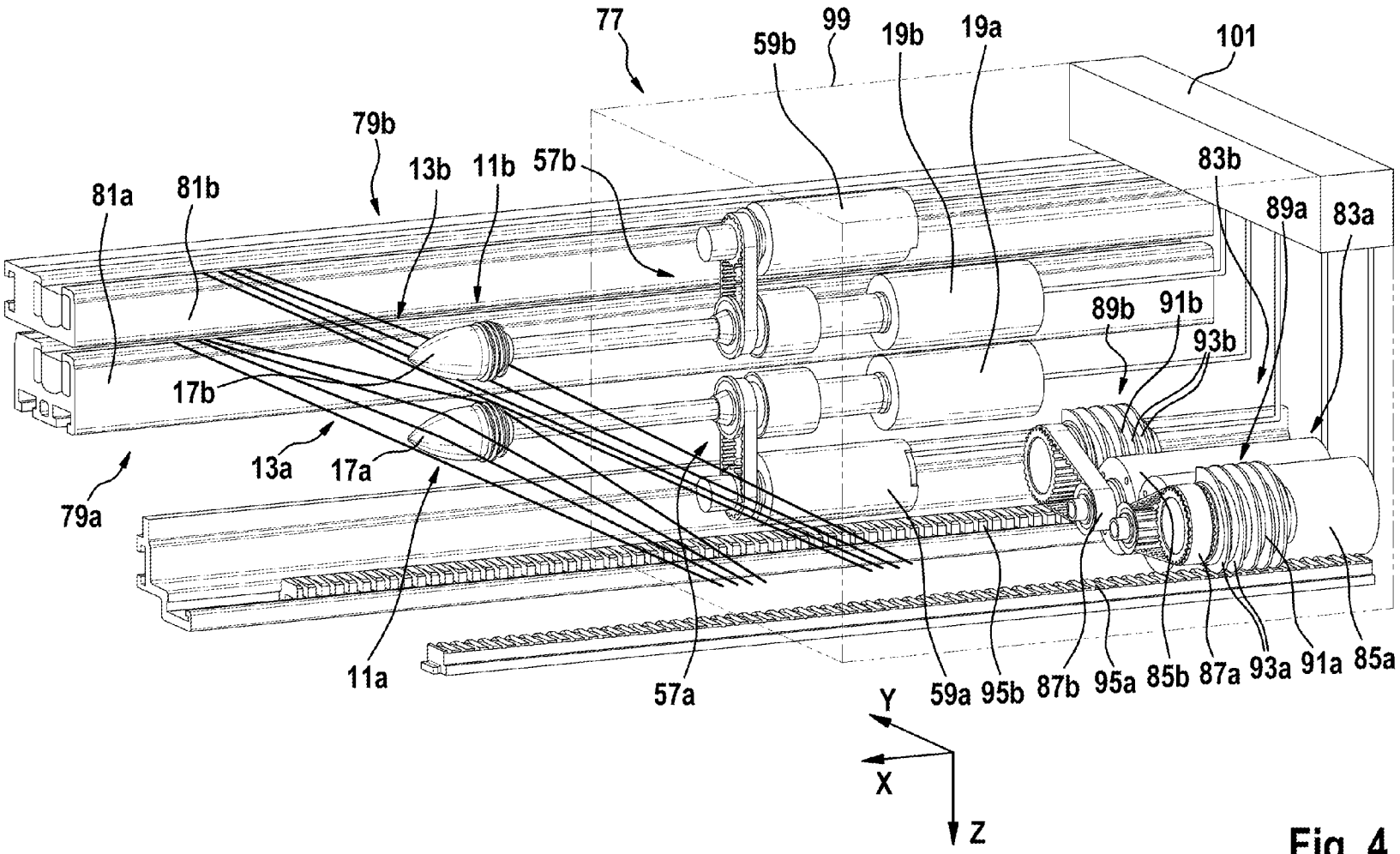
FIG. 4 shows two superposed stenter frames and one thread separating apparatus according to the invention each in perspective view.

FIG. 4 shows a knotting machine 77 with two thread separating apparatuses 11*a*, 11*b* according to the invention on two thread tensioning devices 79*a*, 79*b*. The thread tensioning devices 79*a*, 79*b* each have mutually opposed stenter frames 81*a*, 81*b* on which each of two thread layers 13*a*, 13*b* is tensioned. The thread tensioning apparatuses 79*a*, 79*b* are movable relative to one another in the X direction. The structure and operating mode of such thread tensioning devices are known to the person skilled in the art from the prior art and therefore do not need to be described in further detail. For reasons of clarity only one side of the stenter frames 81*a*, 81*b* is shown in FIG. 4.

Each thread separating apparatus 11*a*, 11*b* has a drive 19*a*, 19*b* for the first spindle 17*a*, 17*b* and a drive 59*a*, 59*b* for the second spindle 41*a*, 41*b*.

Each thread separating apparatus 11*a*, 11*b* is fitted with a separate feed drive 83*a*, 83*b* consisting of a motor 85*a*, 85*b*, toothed belt 87*a*, 87*b* and transmission 89*a*, 89*b*. The transmissions 89*a*, 89*b* according to the exemplary embodiment shown each have a gear wheel 91*a*, 91*b* with a helical thread 93*a*, 93*b*. The gear wheels 91*a*, 91*b* in this case engage with the thread 93*a*, 93*b* into a toothed rack 95*a*, 95*b* of the thread tensioning devices 79*a*, 79*b*. According to the direction of rotation of the gear wheel 91*a*, 91*b*, the associated toothed rack 95*a*, 95*b* and consequently the associated thread layer 13*a*, 13*b* of the associated thread separating apparatus 11*a*, 11*b* are moved with respect to one another in the X direction.

All the drives 19*a*, 19*b*, 59*a*, 59*b*, 83*a*, 83*b* are firmly mounted in a housing 99, i.e. they are movable together in the X direction and are in communication with a control device 101.

The thread separating apparatuses 11*a*, 11*b* are adjusted in height (Z direction) relative to the thread layers 13*a*, 13*b* so that the axis of rotation of the grouping spindle 17*a* of the thread separating apparatus 11*a* travels below the lower thread layer 13*a* and the axis of rotation of the other grouping spindle 17*b* of the thread separating apparatus 11*b* travels over the upper thread layer 13*b*. If individual threads of the two thread layers 13*a*, 13*b* are separated, with the aid of parts of the knotting machine not shown in FIG. 4, the cut ends of the separated individual threads can be gripped and linked to one another.

A second embodiment of the thread separating apparatus differs from the embodiment described above in that instead of a second spindle another transport apparatus in the form of a conveyor belt is provided. The conveyor belt can, for example, comprise a notched transport belt in the external notches whereof the separated threads can be transported away from the receiving position with the movement of the transport belt on two gear wheels. The notched transport belt can in this case transport the threads away in the X direction.

The entire apparatus comprising grouping spindle 17 and transport spindle 41 functions as follows: as has already been described further above, the threads 15 of one thread layer 13 are already separated by the grouping spindle 17. For the thread separation the grouping spindle 17 is preferably not driven uniformly but according to the angular region either very rapidly (dead rotation region) or slowly or intermittently (release rotation region), i.e. the grouping spindle 17 is briefly stopped or accelerated. The grouping spindle 17 thus executes a plurality of "jerking movements" during a revolution. The dead rotation region 73 in which no threads are released can be moved over without the grouping spindle 17 coming to a standstill. Each of the grouped threads of the rear thread pitch is then successively released onto the transport spindle 41 and each released thread is transported to the second release edge in the X direction where it is released onto the cylinder part 51. Whilst the first spindle 17 is located in the release rotation region 71, the transport spindle 41 is advantageously driven at a higher rotational speed than the grouping spindle 17 so that a higher axial transport speed (X direction) of the threads is achieved on the transport spindle 41 than in the guide track 27 of the grouping spindle 17. The axial transport speed on the transport spindle 41 is in this case preferably a factor of 10 to 100, preferably 30 to 90 and particularly preferably 40 to 80 times higher than the axial transport speed on the grouping spindle 17. This has the advantage that per revolution of the transport spindle a maximum of one single thread falls from the grouping spindle 17 and that consequently two successively released threads are received in different thread pitches of the guide track 43. For checking the separating result the separated thread is preferably released into the fourth plane 49. With one thread in the measurement position defined by the fourth plane, the rotation of the transport spindle 41 can be stopped for the examination. At the measurement position it is checked by means of sensors (e.g. camera 40) whether only one thread is present or not and whether the thread colour or other thread properties such as, for example, thread thickness, S or Z direction of the thread when this is a multifilament yarn, are correct or not. In the thread testing apparatus at least one of the threads 15 released from the first spindle is monitored in the third plane 39 or in the fourth plane 49 or during operation in between. The number of threads laid in a certain zone is counted where the certain zone is located behind the release edge 31 and the first spindle 17. The grouping spindle 17 and the transport spindle 41 thus execute jerking movements which are matched to one another in time.

The thread separating apparatus according to the invention is advantageously integrated in a knotting machine which operates with two thread layers. For linking two threads in each case one thread of each thread layer is separated with a thread separating apparatus according to the invention, gripped with a hook, cut and then knotted together. The knotted thread is finally drawn out with the aid of a yarn drawing out device.

The knotting machine is an arrangement of two separating apparatuses, a first motor for the feed of the first thread separating apparatus relative to the first thread layer, a second motor for the feed of the second thread separating apparatus relative to the second thread layer and a control device for the afore-mentioned components.

In summary the thread separating apparatus according to the invention can be described as follows: each thread separating apparatus consists of two coaxial rotation parts (spindles) which each have a surface with an external thread. The two threads for example have the same pitch and the same profile (trapezoidal thread for example). At the release edge the diameter Ø2 (corresponds to the groove base of the thread 45) of the second spindle (transport spindle 41) is smaller than the diameter Ø1 of the first spindle (grouping spindle 17). The second spindle is disposed rotatably with respect to the first spindle. Each spindle is rotationally driven with its own motor. The second spindle is connected to the motor axis with the aid of a belt and a roller. The two spindles preferably rotate at a different speed during operation.

KNOTTING PROCESS

Preparation for Knotting

Prior to the knotting, the threads of each thread layer are tensioned and clamped at least at two points in a stenter frame. Each thread layer is located in a first plane. Then the knotting machine is placed on the stenter frame (cooperation of each feed motor with the stenter frame of the thread layer) and the two thread layers are located between the two axis of rotation of the thread separating apparatuses of the knotting machine. In an advantageous variant the spacing in the Z direction between the axis of rotation of the spindle and the associated thread layer is adjustable so that the maximum Z tension acting on the deflected threads can be reconciled with the thread properties. In another variant the two thread layers are located outside the two axes of rotation of the thread separating apparatuses of the knotting machine.

Thread Separation:

1. Initial Position

For each thread layer located in a first plane, the first spindle is brought in contact with the first thread of the thread layer (by hand or by motor feed). Each feed motor of the knotting machine allows the movement of the separating apparatus relative to the associated thread layer so that each first spindle comes contact with the associated thread layer. From this initial position the feed of each thread separating apparatus relative to the stenter frame (X direction, after the thread layer) and the rotation of each spindle is started. Hereinafter the next process steps are for simplification only described for a single thread layer:

2. Deflection

In contact with the ogival surface of the first spindle the outermost threads of the thread layer are deflected from the first plane as far as to a second plane. This means that due to the deflection effected by the ogival surface a vertical tension (Fz) acting in the Z direction is produced on each deflected thread (FIG. 3).

3. Transport on the First Spindle

If the threads on the grouping spindle reach the thread inlet, one or more threads are grouped in the thread and during each rotation of the first spindle are transported in the thread notch along the first spindle in the X direction. As a result of the deflection in the X direction, a horizontal tension (Fx) is produced for each thread. That is to say, the feed of the thread separating apparatus is selected to be smaller than the transport speed of the threads in the X direction on the first spindle relative to the thread layer. The Z tension produced remains substantially the same in this phase.

4. Separation

One group of threads reaches the rear end of the first spindle. In the release rotation region the speed of the first spindle is reduced. If the threads reach the (rear) end of the first spindle, the grouped threads are successively released at the first release edge onto the second spindle (in a third plane). The thread tension acting in the X and Z direction and the thread geometry help in that the threads received in the thread of the first spindle are held against the thread flank facing away from the spindle tip.

The rear thread of the grouped threads (thread 15' in FIG. 2) is released as the first and before the other threads (thread 15"). With the release of the thread onto the second smaller-diameter spindle a sudden reduction in the thread tension of the highly tensioned thread is obtained in the Z direction. Because the receiving position on the second spindle (third plane) when seen in the Z direction is located between the first plane of the thread layer and the second plane and in the Z direction is located at a distance from the first plane, a thread tension still remains however for the released threads in the Z direction.

When all the rear threads are released from the first spindle, the first spindle is then set more rapidly into motion in order to transport a further group of threads on the first spindle onto the release edge (dead rotation region).

5. Reinforcement of the Separation

In the thread notch of the second spindle (transport spindle) each successively separated thread is transported away from the first spindle very rapidly in the X direction upon rotation of the second spindle. For this purpose the second spindle is rotationally driven in the release rotation region of the first spindle in such a manner that the transport speed of one thread in the thread on the second spindle in the X direction is greater than the transport speed of a thread in the thread on the first spindle in the X direction. The very rapid transport movement on the second spindle enables an intensification of the separation process since the next thread released from the first spindle only reaches the thread of the second spindle after at least one revolution of the second spindle.

On the second spindle a tension still acts in the vertical direction (Z direction) and horizontal (X direction) direction on the separated threads. At the rear end of the second spindle each thread is again released at the second release edge and the thread reaches a test position in the cylinder part of the second spindle.

6. Test Position

In the test position the separation result is checked with a thread testing apparatus (preferably a camera or a tension sensor). During the testing a double thread can be detected (with a camera or a tension sensor), the colour of the separated threads and/or further thread properties of the thread can be determined (with camera 40).

If the thread is located in the test position, the rotation of the second spindle is preferably stopped during the test time in order to perform the test.

If the separation was successful, i.e. if only one single thread is located in the test position and possibly the separated thread—as expected—has the correct colour and the correct diameter, the separated thread is gripped with a hook and lead away for subsequent cutting and linking to a separated thread of the other thread layer. The second thread is then again set in rotation in order to transport another thread into the test position.

If a double thread or an incorrect thread property is detected, the drives of the first and second spindles as well as the feed of each thread separating apparatus of the knotting machine are immediately stopped (the thread testing apparatus is connected to the control of the spindles). The spindles are raised or lowered in the Z direction so that all the threads are no longer in contact with the spindles. Each separating apparatus is then brought back into an initial position with respect to the disposed thread layer and the thread separation process is re-started.

In one variant the double thread is automatically returned from the test position onto the second spindle or also onto the first spindle, e.g. by reversing the direction of rotation of the first and second spindle and "raising" the threads at each release edge by means of at least one entrainer which is disposed on the shoulder of the second spindle forming the second release edge or on the rear end of the first spindle. The thread separation is then re-started.

At least for the first thread of each thread layer which is tested, the diameter of the thread is preferably also measured. With this measurement the thread density is approximately known and the feed can be adjusted automatically (the thread testing apparatus is connected to the control or the feed) or by hand.

The feed of the knotting machine is selected so that the feed is the same or lower than the transport speed of the threads in the X direction on each spindle (which depends on the slope and rotational speed).

It is feasible that the spindles are not disposed coaxially but adjacently in the thread direction (Y direction).

Figure 5:
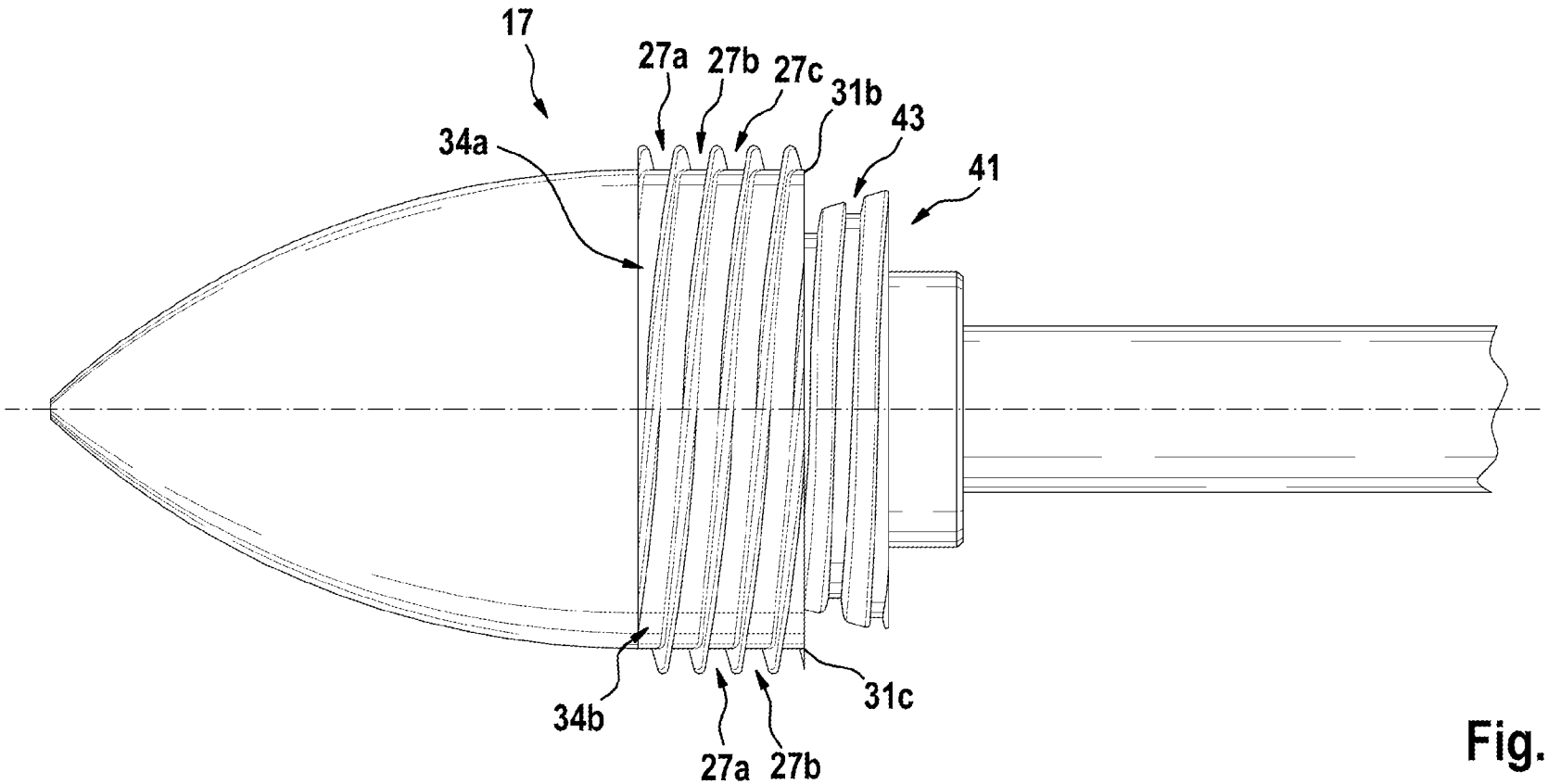
FIG. 5 shows a variant with a multi-start thread on the grouping spindle.
Figure 6:
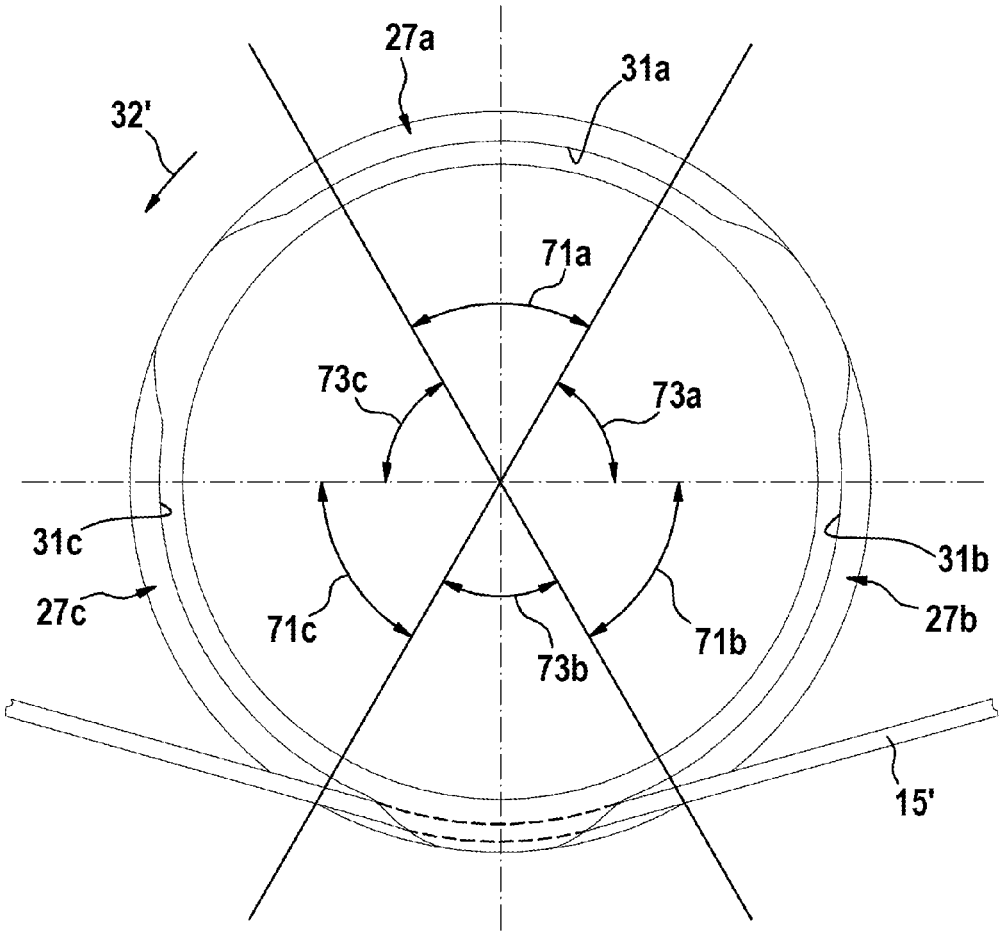
FIG. 6 shows a rear view of the grouping spindle from FIG. 5 and a thread deflected as far as into the second plane and FIG. 7 shows a variant of the thread separating apparatus with a single spindle.

A further embodiment of the invention is shown in FIG. 5 and FIG. 6. In order to avoid unnecessary repetitions, in the following only the differences compared to the other embodiments are described: The first spindle has three helical guide tracks 27*a*, 27*b*, 27*c* (between two and five guide tracks are feasible) in the form of a multi-start thread. Each guide track 27*a*, 27*b*, 27*c* ends at its own release edge 31*a*, 31*b*, 31*c*. The three inlets (inlets 34*a*, 34*b* can be identified in FIG. 5) of the three guide tracks 27*a*, 27*b*, 27*c* or the three first release edges 31*a*, 31*b*, 31*c* are located at the same height in the X direction. As a result, a larger number of threads can be received in guide tracks 27*a*, 27*b*, 27*c* of the first spindle 17 during a rotation of the first spindle. Accordingly as a result of the rotational position of the first spindle 17, three release rotation regions 71*a*, 71*b*, 71*c* (three angular sections) and three dead rotation regions 73*a*, 73*b*, 73*c* (three angular sections) are determined relative to the threads 15 received in the guide tracks 27*a*, 27*b*, 27*c*. The three release rotation regions and the three dead rotation regions are distributed about the axis of rotation 18 uniformly in 120° angular sections. Each thread of the thread layer during rotation of the first spindle 17 in direction of rotation 32' is only transported in one of the three guide tracks 27*a*, 27*b*, 27*c* along the first spindle 17 and released at one of the three release edges 31*a*, 31*b*, 31*c* to the second spindle 41. As FIG. 5 shows, the second spindle 41 in this exemplary embodiment has a frustoconical cross-section. With such a shape the second spindle 41 produces a higher thread tension in the Z direction than with a cylindrical shape.

Figure 7:
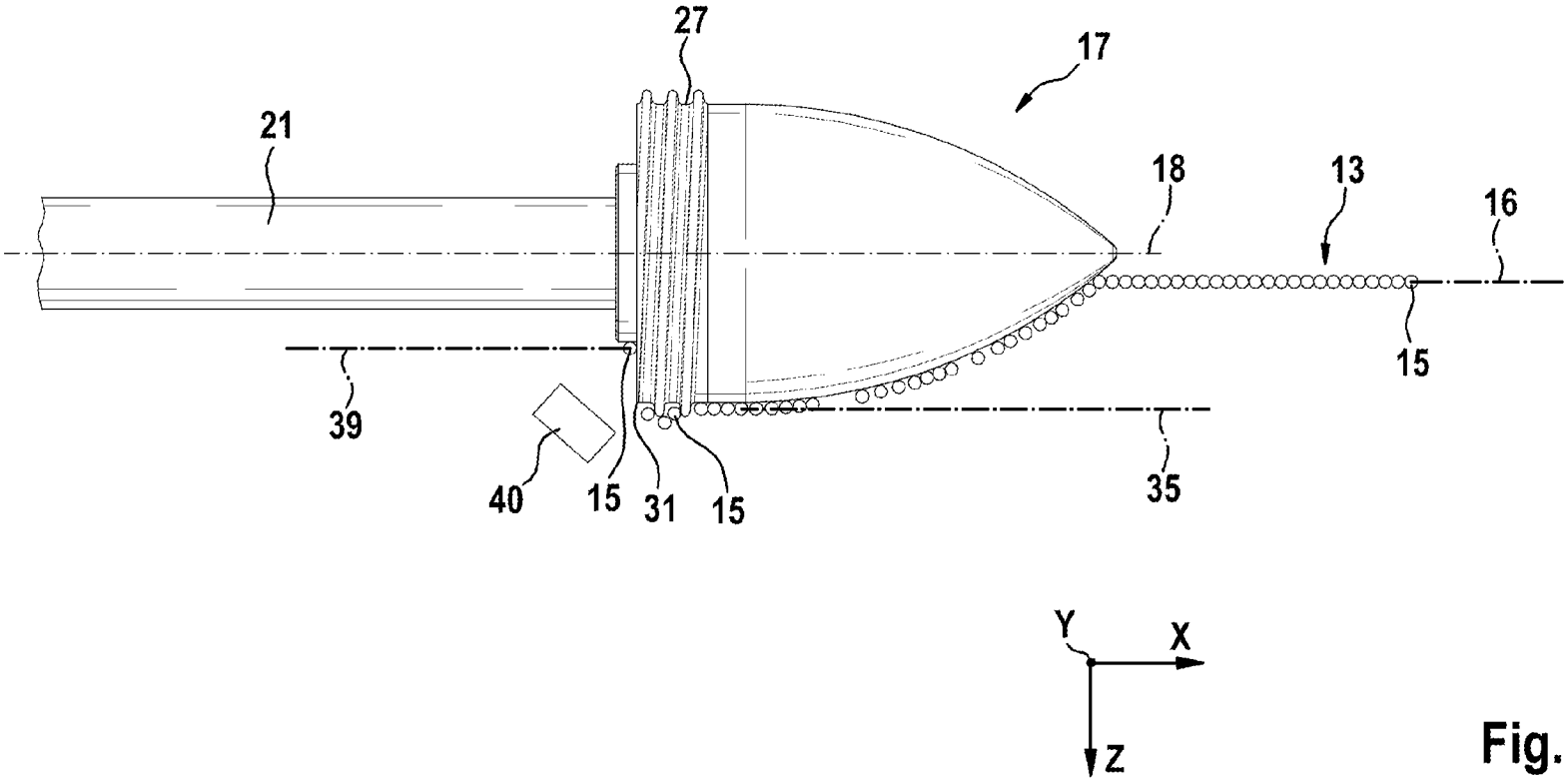

FIG. 7 shows a variant of the thread separating apparatus 11 which has only a single (first) spindle 17 which is formed and driven like the first spindle 17 of the first embodiment. This (single) spindle 17 is rotatable about an axis of rotation 18 by means of a drive shaft 21 driven by a motor (not shown in FIG. 7) and is movable with respect to the thread layer 13 in the X direction so that the threads of the thread layer 13 can be deflected from a first plane 16 into a second plane 35 and can be transported in a helical guide track 27 along the spindle 17. The helical guide track 27 leads the grouped threads 15 up to the release edge 31 of the single spindle 17. In the release rotation region of the spindle 17 the rotational speed of the spindle 17 is reduced. The threads 15 of the thread layer are successively released at the first release edge 31 of the spindle 17 from the second plane 35 into a third plane 39. A thread testing apparatus (e.g. a camera 40) monitors a thread 15 released from the spindle 17 at the first release edge 31 and being located in the third plane and is in communication with a control device for controlling the drive. Each of the separated threads 15 released by the single spindle 17 is engaged with a hook (not shown) in the third plane 39.

The thread separating apparatus according to the invention can also be used if the thread layer is disposed with lease bands. In this case the thread separating apparatus cooperates with a lease module which is movable by a predetermined angle on each side from the first plane of the warp thread layer and which has at least two lease tubes for receiving the lease bands so that the threads of the thread layer are released from the lease. The threads are then transported on the grouping spindle of the thread separating apparatus and released successively by the grouping spindle. It is thereby possible to separate a single thread from the thread layer disposed in the lease bands.

What is claimed is:

1. Thread separating apparatus (11) for separating a thread (15) from a thread layer (13) defining a first plane (16) and comprising a plurality of tensioned threads (15) disposed adjacent to one another and substantially parallel to one another, comprising, a first rotatable spindle (17) in the circumference whereof a first helical guide track (27) is provided, which first spindle during rotation is suitable for transporting a plurality of threads in the first helical guide track (27) along the first spindle (17) further characterized by a deflecting part (25) for a deflection of the threads (15) received in the first guide track (27) from the first plane (16) into a second plane (35), and a first release edge (31) which is provided on the first spindle (17) and on which the first helical guide track (27) ends for the release of the threads (15) from the first guide track (27) into a third plane (39).

2. The apparatus according to claim 1, characterized in that the first release edge (31) is realized by a diameter reduction of the first spindle (17) which release edge (31) is formed in the base of the first helical guide track (27).

3. The apparatus according to claim 1, characterized in that the deflecting part (25) has a surface (23) which is inclined with respect to the first plane (16) of the thread layer (13).

4. The apparatus according to claim 1, characterized in that the deflecting part (25) is part of the first spindle (17) and has an ogival surface (23).

5. The apparatus according to claim 1, characterized in that a plurality of helical guide tracks (27*a*, 27*b*, 27*c*) are formed in the circumference of the first spindle (17) whereby a multistart thread is formed.

6. The apparatus according to claim 1, characterized in that a transport apparatus (41) is provided on the release edge (31) for transporting away the threads (15) released by the first spindle (17).

7. The apparatus according to claim 6, characterized in that the threads (15) are transported at a first transport speed in the first guide track (27) and at a second transport speed on the transport apparatus (41), wherein the second transport speed is greater than the first transport speed.

8. The apparatus according to claim 6, characterized in that the first spindle (17) is driven by a first drive (19) and the transport apparatus (41) is driven by a second drive (59).

9. The apparatus according to claim 6, characterized in that the transport apparatus is formed by a second rotatable spindle (41) in the circumference whereof a second helical guide track (43) is provided.

10. The apparatus according to claim 9, characterized in that the first spindle (17) and the second spindle (41) are disposed coaxially with respect to one another.

11. The apparatus according to claim 9, characterized in that the second spindle (41) has a second release edge (47) for the release of the threads (15) from the second guide track (43) into a fourth plane (49).

12. The apparatus according to claim 1, characterized in that the thread separating apparatus has a feed drive (83*a*, 83*b*) for displacing the first spindle (17) with respect to the thread layer (13) substantially parallel to the first plane (16) of the thread layer (13).

13. The apparatus according to claim 12, further characterized by a control device (101) for controlling the feed drive (83*a*, 83*b*) and a thread testing apparatus which is in communication with the control device (101) and which is suitable for monitoring a thread (15) released by the first spindle (17).

14. The apparatus according to claim 1, characterized in that about an axis of rotation (18) of the first spindle (17) a first angular section is defined as release rotation region (71) and a second angular section is defined as dead rotation region (73) wherein the first spindle (17) is rotationally driven more slowly in the release rotation region (71) than in the dead rotation region (73).

15. Knotting machine (77) having two thread separating apparatuses (11) according to claim 1.

16. Leasing machine having one thread separating apparatus (11) according to claim 1.

17. Drawing-in machine having one thread separating apparatus (11) according to claim 1.

* * * * *

UNITED STATES PATENT AND TRADEMARK OFFICE

CERTIFICATE OF CORRECTION

PATENT NO. : 9,200,387 B2
APPLICATION NO. : 14/563061
DATED : December 1, 2015
INVENTOR(S) : Schadler et al.

It is certified that error appears in the above-identified patent and that said Letters Patent is hereby corrected as shown below:

In the specification,

Column 7, line 46, please add -- 31 -- between "edge" and "onto the"

Column 8, line 8, please add -- 31 -- between "edge" and "in the"

Column 12, line 53, please add -- 15 -- between "threads" and "of the"

Signed and Sealed this
Twenty-second Day of March, 2016

Michelle K. Lee

Michelle K. Lee
*Director of the United States Patent and Trademark Office*